US008863313B2

(12) United States Patent
Grilliot et al.

(10) Patent No.: US 8,863,313 B2
(45) Date of Patent: Oct. 21, 2014

(54) DRAG HARNESS WITH ARM LOOPS AND HANDLE

(75) Inventors: William L. Grilliot, Dayton, OH (US); Mary I. Grilliot, Dayton, OH (US); Patricia K. Waters, Tipp City, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 78 days.

(21) Appl. No.: 11/807,101

(22) Filed: May 25, 2007

(65) Prior Publication Data

US 2008/0289083 A1 Nov. 27, 2008

(51) Int. Cl.
*A62B 17/00* (2006.01)
*A62B 35/00* (2006.01)

(52) U.S. Cl.
CPC ..... *A62B 35/0025* (2013.01)
USPC ..... 2/81; 2/93; 294/74

(58) Field of Classification Search
CPC ..... B66C 1/18; B66C 1/12; A62B 35/0037; A62B 35/0006; A62B 35/0075
USPC ..... 2/69, 81, 94, 79, 227, 97, 69.5, 456, 2/305, 455, 310, 458; 383/6, 20; 182/3–7; 294/74, 152
See application file for complete search history.

(56) References Cited

U.S. PATENT DOCUMENTS 2,705,987 A * 4/1955 Schulte ..... 383/28
2,785,725 A * 3/1957 Gold ..... 220/9.1
2,935,066 A * 5/1960 Holloway ..... 602/21
2,956,541 A * 10/1960 Rall ..... 434/254
2,979,153 A * 4/1961 Hoagland et al. ..... 182/3
3,074,074 A * 1/1963 Lovering ..... 2/94
3,290,083 A * 12/1966 Norton ..... 294/74
3,409,209 A * 11/1968 Finke ..... 383/20
3,533,107 A * 10/1970 Garbarino et al. ..... 2/93
3,973,643 A * 8/1976 Hutchinson ..... 182/3
3,997,921 A * 12/1976 Knight ..... 2/75
4,239,271 A * 12/1980 Beasley et al. ..... 294/74
4,449,253 A * 5/1984 Hettinger ..... 2/93
4,625,334 A * 12/1986 Proffer ..... 2/1
4,682,671 A * 7/1987 Hengstenberger et al. ..... 182/3
4,696,077 A * 9/1987 Kim ..... 16/114.1
4,854,418 A * 8/1989 Hengstenberger et al. ..... 182/3
5,014,692 A * 5/1991 Rhoades ..... 602/23
D320,696 S * 10/1991 Butler ..... D3/259
5,435,272 A * 7/1995 Epstein ..... 119/770
5,542,123 A * 8/1996 DiPietro ..... 2/80
5,560,083 A * 10/1996 Teixeira ..... 16/411
5,619,751 A * 4/1997 Ray et al. ..... 2/102
D394,956 S * 6/1998 Fruecht ..... D3/318
5,921,657 A * 7/1999 Case ..... 362/191
6,125,792 A * 10/2000 Gee ..... 119/770

(Continued)

*Primary Examiner* — Richale Quinn
(74) *Attorney, Agent, or Firm* — Wood, Phillips, Katz, Clark & Mortimer

(57) ABSTRACT

A drag harness (20) is provided and includes two arm loops (40), each of which is adapted to receive a separate arm (42) of a wearer (24), and an elongate handle (44) having a length (L) extending from a first end (46) to a second end (48) spaced from the first end (46) by the length (L). One of the arm loops (42) extends from the first end (46), and the other of the arm loops (42) extends from the second end (48). The handle (44) is a separate component that is attached to the arm loops (42) whereby a rescuer (26) grasping the handle (44) can drag the wearer (24) with the wearer (24) in a supine position.

8 Claims, 3 Drawing Sheets

(56) References Cited

U.S. PATENT DOCUMENTS

| | | | | |
|---|---|---|---|---|
| 6,205,584 | B1 * | 3/2001 | Yocco | 2/69 |
| 6,487,725 | B1 * | 12/2002 | Jordan | 2/94 |
| 6,637,242 | B2 * | 10/2003 | Masters | 70/16 |
| 6,658,666 | B2 * | 12/2003 | Schweer | 2/94 |
| 7,963,365 | B2 * | 6/2011 | Grilliot et al. | 182/3 |
| 2002/0052270 | A1 * | 5/2002 | Hinds | 482/126 |
| 2004/0004367 | A1 * | 1/2004 | Main et al. | 294/150 |
| 2005/0087573 | A1 * | 4/2005 | Unsworth et al. | 223/112 |
| 2005/0173188 | A1 * | 8/2005 | Lewis et al. | 182/3 |
| 2005/0211188 | A1 * | 9/2005 | Grilliot et al. | 119/770 |
| 2006/0070800 | A1 * | 4/2006 | Lewis et al. | 182/3 |
| 2007/0044197 | A1 * | 3/2007 | Turcotte et al. | 2/69 |
| 2007/0084667 | A1 * | 4/2007 | Waters et al. | 182/3 |
| 2007/0169246 | A1 * | 7/2007 | Sloan et al. | 2/81 |
| 2007/0192926 | A1 * | 8/2007 | Fee et al. | 2/81 |
| 2008/0289086 | A1 * | 11/2008 | Grilliot et al. | 2/455 |

* cited by examiner

DRAG HARNESS WITH ARM LOOPS AND HANDLE

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD OF THE INVENTION

The invention relates to drag harnesses such as are worn by firefighters and other emergency workers to allow a rescuer to drag a wearer who is lying in a supine position from a perilous situation.

BACKGROUND OF THE INVENTION

Drag harnesses of the general type noted above are known, as shown, for example, by the numerous embodiments mentioned and/or described in co-pending application Ser. No. 11/135,082, filed May 23, 2005, titled "Drag Harness Improvements", and naming William L. Grilliot and Mary I. Grilliot as inventors. It is important that a rescuer obtain the best possible grip on the drag harness during a rescue attempt, and accordingly, there is a continuing desire to improve drag harnesses in this regard.

SUMMARY OF THE INVENTION

According to one feature of the invention, a drag harness includes two arm loops, each of which is adapted to receive a separate arm of a wearer, and an elongate handle having a length extending from a first end to a second end spaced from the first end by the length. One of the arm loops extends from the first end, and the other of the arm loops extends from the second end. The handle is a separate component that is attached to the arm loops whereby a rescuer grasping the handle can drag the wearer with the wearer in a supine position.

In one feature, the handle includes a hollow interior extending along the length.

As one feature, portions of the two arm loops pass through the hollow interior.

According to one feature, the hollow interior is defined by a length of tubing.

In one feature, the hollow interior is defined by a folded piece of fabric with two edges joined by a seam extending along the length of the handle.

As one feature, each end of the handle includes a folded fabric tab that surrounds part of the corresponding arm loop, with facing portions of the tab being connected to each other. As a further feature, the facing portions are connected with stitching.

According to one feature, the two arm loops are defined by a continuous length of flexible material.

In one feature, each arm loop is a separate component that is attached to the corresponding one of the first and second ends.

As one feature, the handle is made from webbing.

In one feature, each of the arm loops is made from a non-abrading rope.

Other objects, features, and advantages of the invention will become apparent from a review of the entire specification, including the appended claims and drawings.

DETAILED DESCRIPTION OF THE PREFERRED EMBODIMENT

Figure 1:
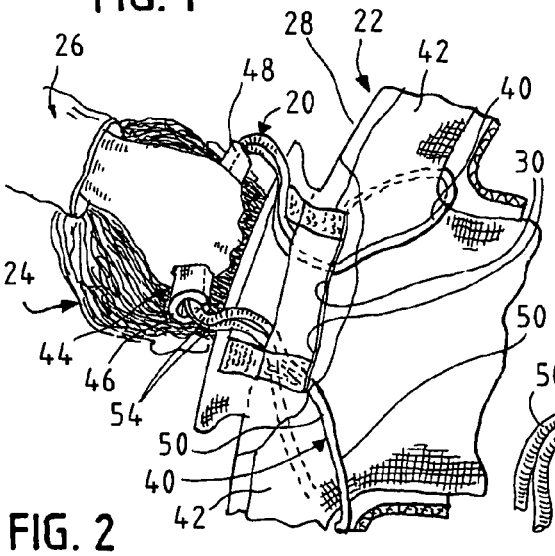
FIG. 1 is a perspective view from behind of a firefighter wearing a protective coat and a drag harness embodying the present invention during a rescue attempt.

As illustrated in FIG. 1, a drag harness 20 in combination with a protective coat 22 are shown on a wearer 24, while a rescuer 26 drags the wearer 24 who is in a supine position. The protective coat 22 may be similar to many conventional types of protective garments worn by firefighters and other emergency workers such as are known to those skilled in the art and therefore those common features will not be discussed in detail herein. For example, the protective coat 22 may include a protective outer shell 28 and, optionally, one or more thermal and/or water resistant liners. The drag harness 20 is located substantially within the outer shell 28, but extends out of the outer shell 28 through a pair of openings 30 in the outer shell so that it can be grasped by the rescuer 26 during use, as is known.

Figure 5:
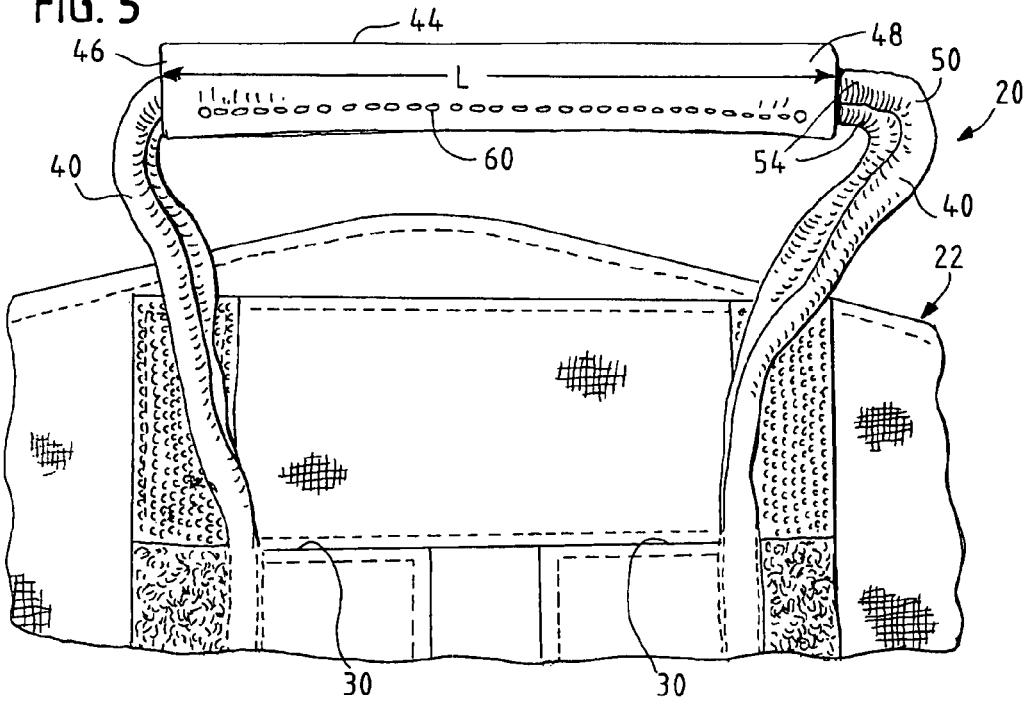
FIG. 5 is an enlarged perspective view of the drag harness and protective coat of FIG. 1.

With reference to FIGS. 1 and 5, the drag harness 20 includes two arm loops 40, each of which is adapted to receive a separate arm 42 of the wearer 24, and an elongate handle 44 having a length L extending from a first end 46 to a second end 48. One of the arm loops 40 extends from the first end 46 and the other of the arm loops 40 extends from the second end 48. The arm loops 40 disclosed herein are capable of being fully spaced from each other. The components forming the loops 40 each defines a permanent size for its respective loop 40. The handle 44 is a separate component that is connected to the arm loops 40 whereby the rescuer 26 can grasp the handle 44 and drag the wearer 24 with the wearer 24 in a supine position.

In the embodiment shown in FIGS. 1 and 5, the two arm loops 40 are defined by a continuous loop of flexible material 50, which is preferably a non-abrading material in the form of a filamentary rope, such as filamentary Kevlar™ or filamentary Nomex™, or any other soft rope of suitable material. While a rope-type construction is preferred for the arm loops 40, strapping, webbing, or any other suitable type construction may be desirable in some applications.

Figure 3:
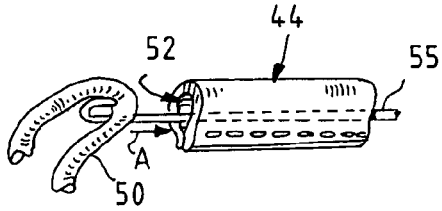
FIGS. 3 and 4 are perspective views showing some assembly steps for the drag harness of FIGS. 1 and 2.
Figure 4:
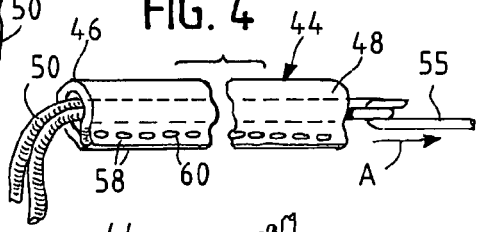

The handle 44 includes a hollow interior 52 extending along the length L, with portions 54 of the arm loops 40 passing through the interior 52. In this regard, as shown in FIGS. 3 and 4, to assemble the drag harness 20 to form the two arm loops 40, the loop of flexible material 50 can be pulled through the interior 52 of the handle 44 using a suitable tool, such as a pull hook 55, as shown by the arrows A.

Figure 2:
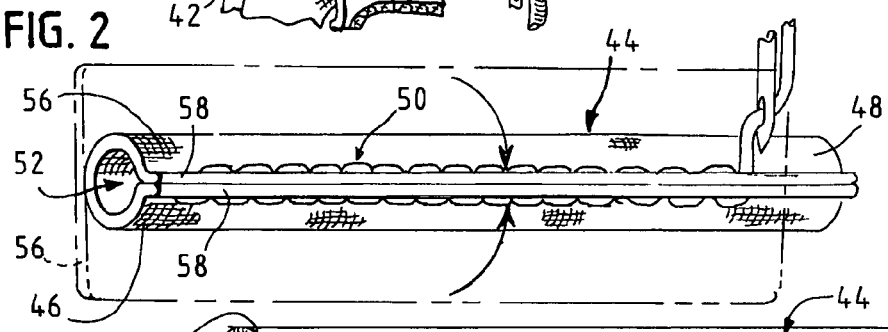
FIG. 2 is an enlarged perspective view of showing the construction of a handle component of the drag harness of FIG. 1.
Figure 6:
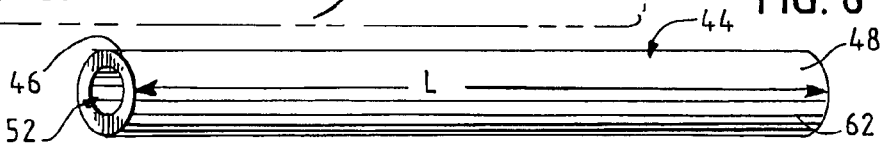
FIG. 6 is an enlarged perspective view showing an alternate embodiment of a handle component of the drag harness of FIGS. 1-5.

As shown in FIG. 2, the handle 44 can be formed from a folded piece of fabric 56, with two elongate edges 58 of the fabric 56 permanently joined by a stitched seam 60 extending along the length L of the handle 44. The folded piece of fabric is a single piece extending continuously between its ends. The hollow interior 52 is defined between the folded portions of the piece of fabric 56. Alternatively, as shown in FIG. 6, the handle 44 can be formed from a cylindrical piece of material, such a length of tubing or hose 62, which is preferably made from a suitable high temperature material, many of which are known. As yet another alternative, the length of tubing 62 can be combined with the folded piece of fabric 56 so that the tubing extends through the hollow interior 52 defined by the fold.

Figure 7:
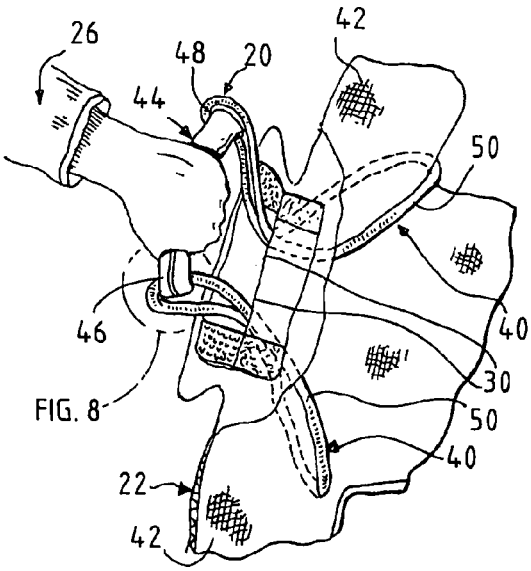
FIG. 7 is a perspective view similar to FIG. 1 but showing an alternate version of a drag harness embodying the present invention.
Figure 8:
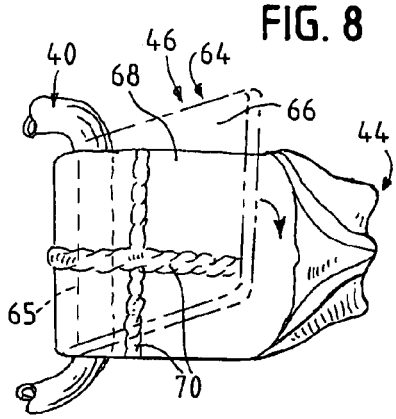
FIG. 8 is an enlarged perspective view showing the constructions of an end portion of a handle component of the drag harness of FIG. 7.
Figure 10:
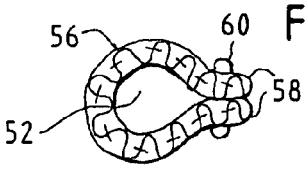
FIG. 10 is an enlarged section view taken from line 10-10 in FIG. 9.
Figure 9:
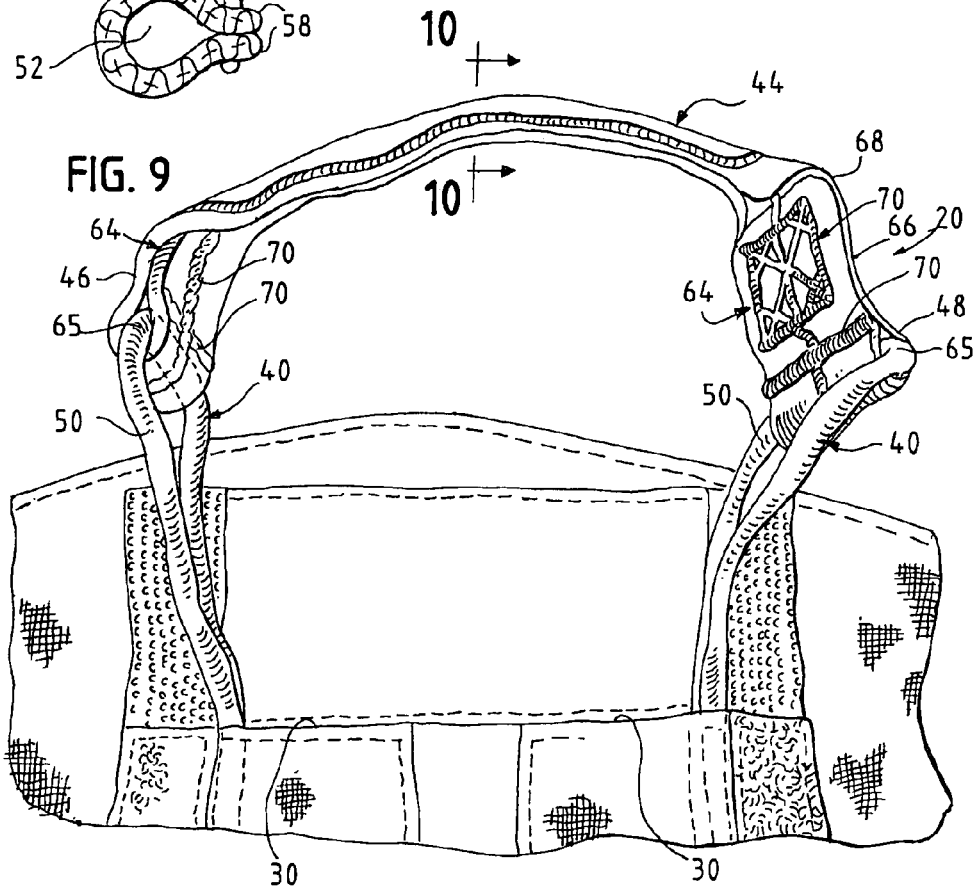
FIG. 9 is an enlarged perspective view similar to FIG. 5, but showing the drag harness of FIG. 7.

FIGS. 7-10 show another embodiment of the drag harness 20, with like reference numbers indicating like components and features. This embodiment differs from that of FIGS. 1-6 in that each of the arm loops 40 is a separate component that is attached to the corresponding one of the first and second ends 46 and 48, with each arm loop 40 being defined by its own continuous loop of flexible material 50, rather than both loops 40 being defined by a single continuous loop of the flexible material 50 as in FIGS. 1-6. As best seen in FIG. 7, it should be noted that because each of the arm loops 40 is a continuous loop of flexible material 50, each of the loops 40 has a permanently fixed continuous length.

Figure 11:
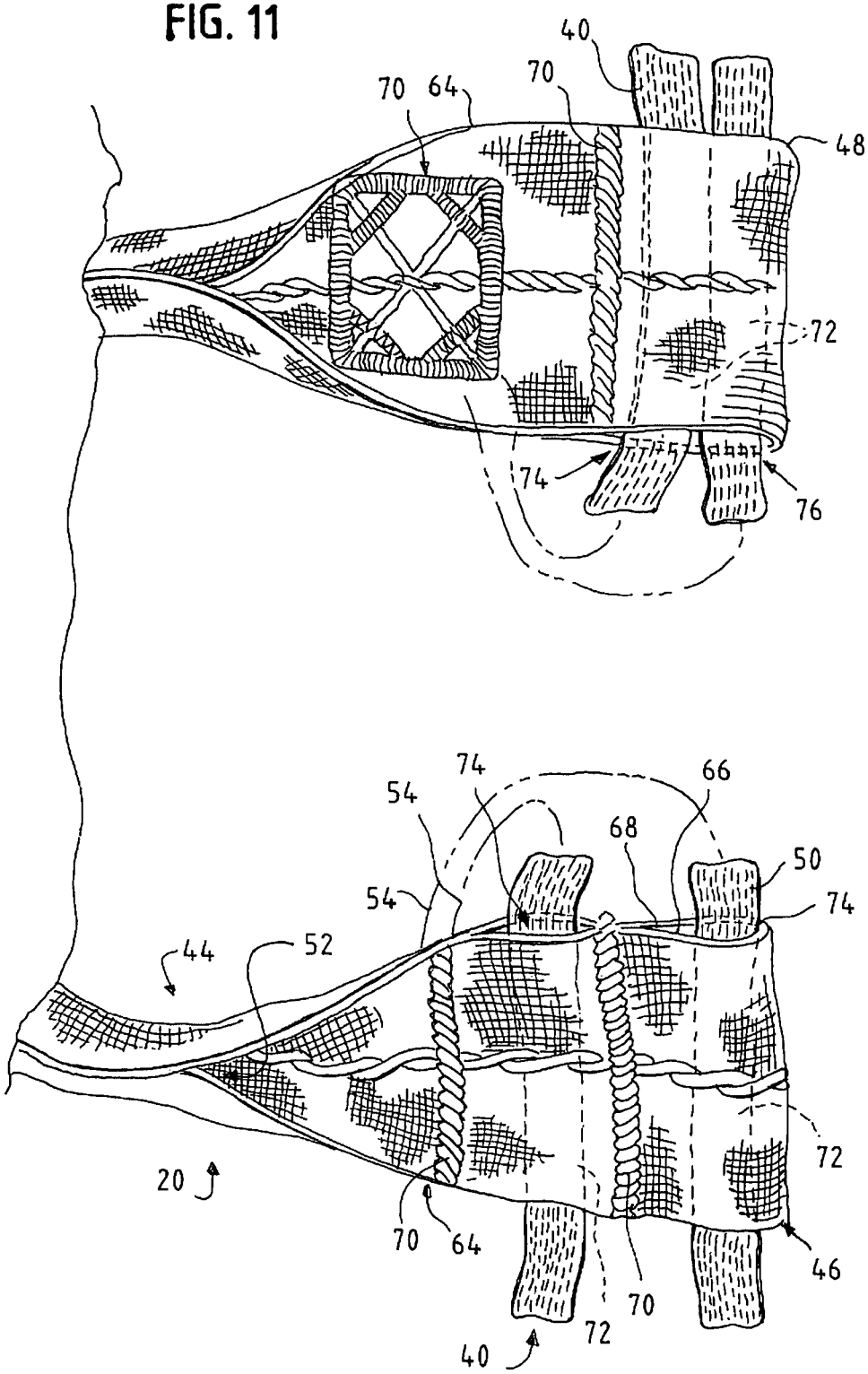
FIG. 11 is a broken perspective view of yet another version of a drag harness embodying the present invention.

FIG. 11 shows yet another embodiment of the drag harness 20 that incorporates features of both the drag harness 20 of FIGS. 1-6 and the drag harness 20 of FIGS. 7-10. More specifically, the drag harness 20 of FIG. 11 incorporates the single continuous loop of flexible material 50 that defines both arm loops 40 with portions 54 (shown schematically in FIG. 11) passing through the hollow interior 52 as in FIGS. 1-6, while also incorporating the folded fabric tabs 64 and stitching 70 in each of the ends 46 and 48 as in FIGS. 7-10. However, FIG. 11 differs from FIGS. 7-10 in that two parts 72 of each arm loop 40 pass through each of the folded fabric tabs 64, rather than a single part 65 as in FIGS. 7-10. In this regard, two possible embodiments for the construction of the tabs 64 are shown in FIG. 11, with the tab 64 at the end 46 providing a separate passage 74 for each of the parts 72, and the tab 64 at the end 48 providing a single passage 76 that receives both of the parts 72. It should be appreciated that the handle 44 can include either of these configurations at bath of its ends 46 and 48. All handles 44 described and shown herein have a permanently fixed length between their ends 46, 48.

As best seen in FIGS. 1, 2, 5, 6, 7, and 9, the length L of each of the disclosed handles 44 is a permanently fixed length.

The invention claimed is:

1. A drag harness comprising:

two arm loops, capable of being fully spaced from each other and each of which is adapted to receive a separate arm of a wearer; and an elongate handle having a length extending from a first end to a second end spaced from the first end by the length, with one of the arm loops extending from the first end, and the other of the arm loops extending from the second end, the handle being a separate component that is connected to the arm loops whereby a rescuer grasping the handle can drag the wearer with the wearer in a supine position, the elongate handle having a permanently fixed length between the first and second ends of the elongate handle, wherein each arm loop is a separate component that forms an endless loop, with one of the endless loops being attached to the first end and the other of the endless loops being attached to the second end, the separate components each defining a permanent size for its respective loop.

2. The drag harness of claim 1 wherein each end of the handle comprises a folded fabric tab that surrounds part of the corresponding arm loop, with facing portions of the tab being connected to each other.

3. The drag harness of claim 2 wherein the facing portions of each tab are connected with stitching.

4. The drag harness of claim 1 wherein the handle comprising webbing.

5. The drag harness of claim 4 wherein the arm loops comprise non-abrading rope.

6. A drag harness comprising:

two arm loops, capable of being fully spaced from each other and each of which is adapted to receive a separate arm of a wearer; and an elongate handle having a length extending from a first end to a second end spaced from the first end by the length, with one of the arm loops extending from the first end, and the other of the arm loops extending from the second end, the handle being a separate component that is connected to the arm loops whereby a rescuer grasping the handle can drag the wearer with the wearer in a supine position, the elongate handle having a permanently fixed length between the first and second ends of the elongate handle, wherein each arm loop is a separate component that forms an endless loop, with one of the endless loops being attached to the first end and the other of the endless loops being attached to the second end, the separate components each defining a permanent size for its respective loop, wherein the elongate handle is formed from a single, folded piece of fabric with two edges joined to each other by a seam extending along the length of the handle.

7. A drag harness comprising:

two arm loops, each of which is adapted to receive a separate arm of a wearer; and an elongate handle having a length extending from a first end to a second end spaced from the first end by the length, with one of the arm loops extending from the first end, and the other of the arm loops extending from the second end, the handle being a separate component that is connected to the arm loops whereby a rescuer grasping the handle can drag the wearer with the wearer in a supine position, wherein the handle comprises a hollow interior extending from the first end to the second end along the length, the hollow interior defined by a folded piece of fabric with two edges permanently joined to each other by a seam extending along the length of the handle, wherein portions of the two arm loops pass through the hollow interior from the first end to the second end, wherein the folded piece of fabric comprises a single piece extending continuously from the first end to the second end of the handle, in combination with a protective coat with a protective outer shell and at least one of: a) a thermal liner; and b) a water resistant liner, the drag harness located substantially within the protective outer shell and extending through the outer shell to be grasped during use.

8. A drag harness comprising:

two arm loops, capable of being fully spaced from each other and each of which is adapted to receive a separate arm of a wearer; and an elongate handle having a length extending from a first end to a second end spaced from the first end by the length, with one of the arm loops extending from the first end, and the other of the arm loops extending from the second end, the handle being a separate component that is connected to the arm loops whereby a rescuer grasping the handle can drag the wearer with the wearer in a supine position, the elongate handle having a permanently fixed length between the first and second ends of the elongate handle, wherein each arm loop is a separate component that forms an endless loop, with one of the endless loops being attached to the first end and the other of the endless loops being attached to the second end, the separate components each defining a permanent size for its respective loop, in combination with a protective coat with a protective outer shell and at least one of: a) a thermal liner; and b) a water resistant liner, the drag harness located substantially within the protective outer shell and extending through the outer shell to be grasped during use.

* * * * *